US005806684A

United States Patent [19]

Strid et al.

[11] Patent Number: 5,806,684

[45] Date of Patent: Sep. 15, 1998

[54] FRACTIONATOR FOR FRACTIONING PARTICULATES IN SUSPENSION

[75] Inventors: Kent Strid, Järbo; Rolf Oswaldsson, Gävle, both of Sweden; Terje Engewik, Drammen; Sigmund Rasmussen, Tranby, both of Norway

[73] Assignee: Kvaerner Pulping AS, Lier, Norway

[21] Appl. No.: 619,676

[22] PCT Filed: Sep. 29, 1994

[86] PCT No.: PCT/SE94/00898

§ 371 Date: Aug. 5, 1996

§ 102(e) Date: Aug. 5, 1996

[87] PCT Pub. No.: WO95/09270

PCT Pub. Date: Apr. 6, 1995

[30] Foreign Application Priority Data

Sep. 30, 1993 [SE] Sweden ..... 9303193-8

[51] Int. Cl.[6] ..... B07B 1/22

[52] U.S. Cl. ..... 209/270; 209/284; 209/288

[58] Field of Search ..... 209/269, 270, 209/274, 284, 288

[56] References Cited

U.S. PATENT DOCUMENTS 5,524,769 6/1996 Spencer ..... 209/284 X

FOREIGN PATENT DOCUMENTS 381 970 6/1982 Germany .

988337 1/1983 U.S.S.R. ..... 209/270

WO82/01830 6/1982 WIPO .

OTHER PUBLICATIONS

Abstract of JP A 57–53253, vol. 6, No. 127, C–113.

*Primary Examiner*—William E. Terrell
*Assistant Examiner*—Tuan N. Nguyen
*Attorney, Agent, or Firm*—Quarles & Brady

[57] ABSTRACT

A fractionator for fractioning a suspension in at least two fractions, including a drum rotatable about a substantially horizontal access and having axially spaced end walls, a centrally arranged inlet for suspension, a flow channel for suspension in the drum, and outlets for fractions. The flow channel extends from the inlet back and forth between the end walls of the drum and radially outwards towards an outlet for the at least two fractions. Preferably the flow channel is defined by substantially concentric cylindrical walls of which every second wall is alternatively tightly connected to one or the other of the two end walls. The fractionator is useful in a continuous fractioning process.

13 Claims, 4 Drawing Sheets

FRACTIONATOR FOR FRACTIONING PARTICULATES IN SUSPENSION

FIELD OF THE INVENTION

The present invention concerns a fractionator for fractioning a suspension in at least two fractions, including a drum rotatable about a substantially horizontal axis and having axially spaced end walls, a centrally arranged inlet for suspension, a flow channel for suspension in the drum and outlet means for fractions.

BACKGROUND OF THE INVENTION

Within the pulp industry there is a need to separate from certain filtrates particles accompanying the filtrate, for instance in the manufacture of recycled paper pulp. In one phase of this process, the recycled pulp is washed, which results in that particularly fillers, such as clay and ash, printing ink and so-called fines are washed out of the pulp in a filtering process, which aims at retaining mainly long fibers. However, it is unavoidable that also long fibers accompany the filtrate, which, thus, will contain long fibers, fines, fillers and printing ink. It is, of course, desirable to be able to recover not only the valuable long fibers, but also fines and fillers, of which particularly the latter are valuable and are needed in papermaking. Besides, for environmental reasons it is favourable if also the finest particles can be recovered and recycled.

In order to separate particles of different sizes in a liquid, it is known to utilize a so-called fractionator. A known such fractionator utilizes a rotatable cylindrical drum, which is internally provided with a helical or spiral channel. This channel has a centrally located entrance and an exit located at the periphery of the drum. The suspension to be fractionated is introduced at the centre of the drum, and the drum is rotated so that the entrance end of the helical channel is filled like a scoop with suspension at each revolution. Between two adjacent channel walls, thus, there will be a suspension plug moving outwards towards the outer loop of the helix and the exit of the channel. Thus, between the channel walls and the suspension plug there will take place a relative movement. As is known from the science of flow this results in that larger particles will gather at the front end of the plug, whereas gradually smaller particles will gather gradually further backwards in the plug, all as counted in its relative direction of movement. Seen in the direction of rotation of the drum, thus, the smallest particles are located foremost and the largest last in the plug. Beneath the drum there are two or more collecting means, which are located in a row after and against each other in the rotational direction of the drum. When a suspension plug is situated in the last turn of the helical channel, the entire plug leaves the exit of the channel in a substantially coherent state when the exit moves over and past the collecting means, the plug falling down towards the collecting means. Thus, in the first collecting means, as counted in the direction of rotation of the drum, the largets particles will be caught, while the smallest will be caught in the last collecting means.

This known fractionator has an inherent drawback in that it operates intermittently, since feeding of suspension and discharge of fractions occurs but once a revolution. Further, the fractioning distance, i.e., the relative flow distance of the suspension, and, accordingly, the fractioning time is determined by the length of the helical channel.

BRIEF SUMMARY OF THE INVENTION

Consequently, the object of the present invention is to provide a fractionator, that enables continuous fractioning and a long fractioning distance.

In a fractionator of the kind initially stated, this is achieved in that the flow channel extends from the inlet forth and back between the end walls of the drum and radially outwards towards outlet means for the at least two fractions. Preferably, the flow channel is defined by substantially concentric cylindrical walls, of which every second in its one axial end is tightly connected to one end wall of the drum and every second in its one axial end is tightly connected to the other end wall of the drum, so that flow can take place between the respective other ends of the cylindrical walls and the one and the other end wall, respectively, of the drum.

The invention will be described hereinafter, reference being made to an exemplifying embodiment shown on the attached drawing, wherein:

DETAILED DESCRIPTION OF THE PREFERRED EMBODIMENTS

Figure 1:
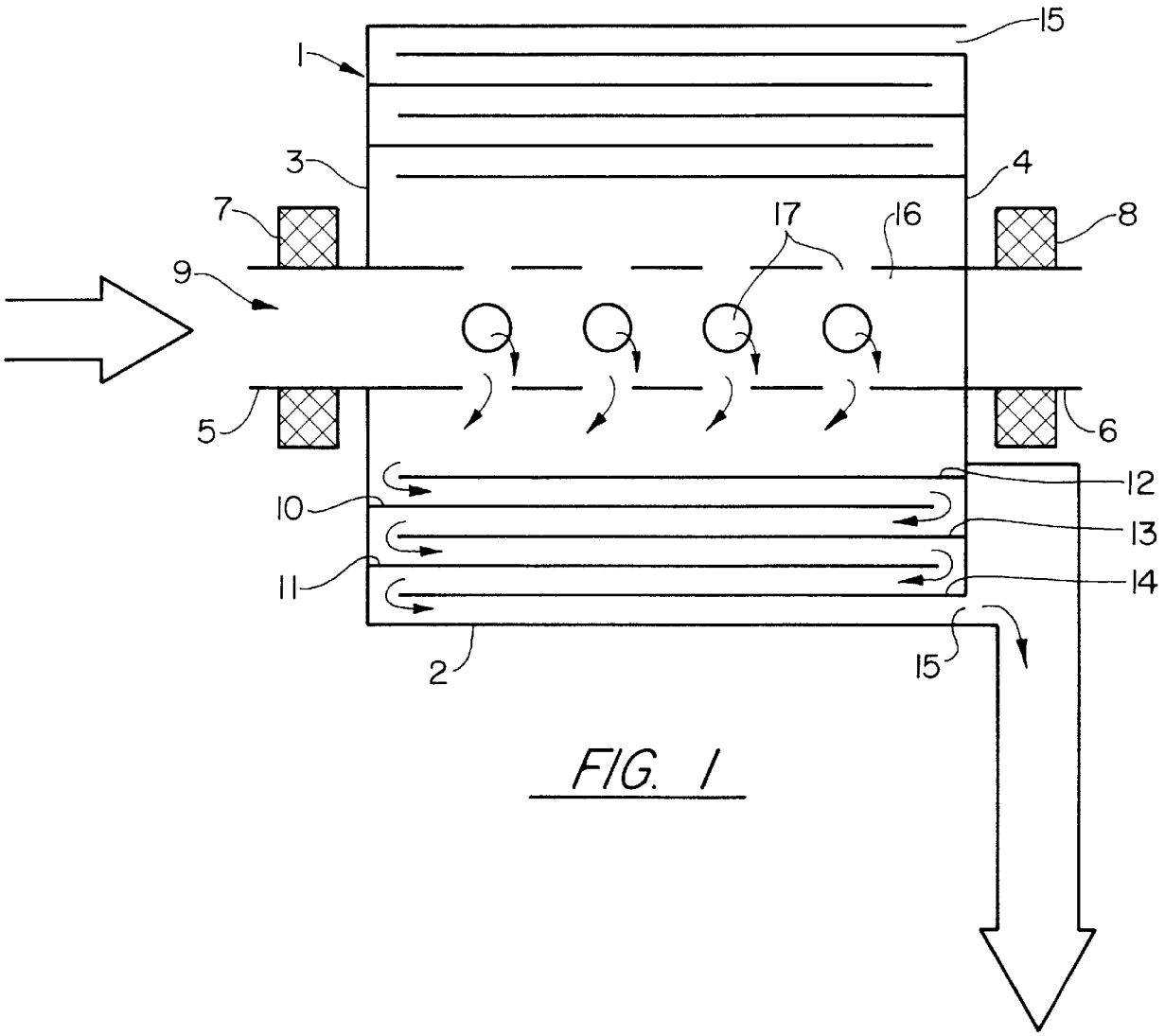
FIG. 1 shows an axial section through a fractioning drum arranged according to the present invention and having an outlet, FIG. 2 schematically shows a cross section through the drum having outlets for three fractions.
Figure 2:
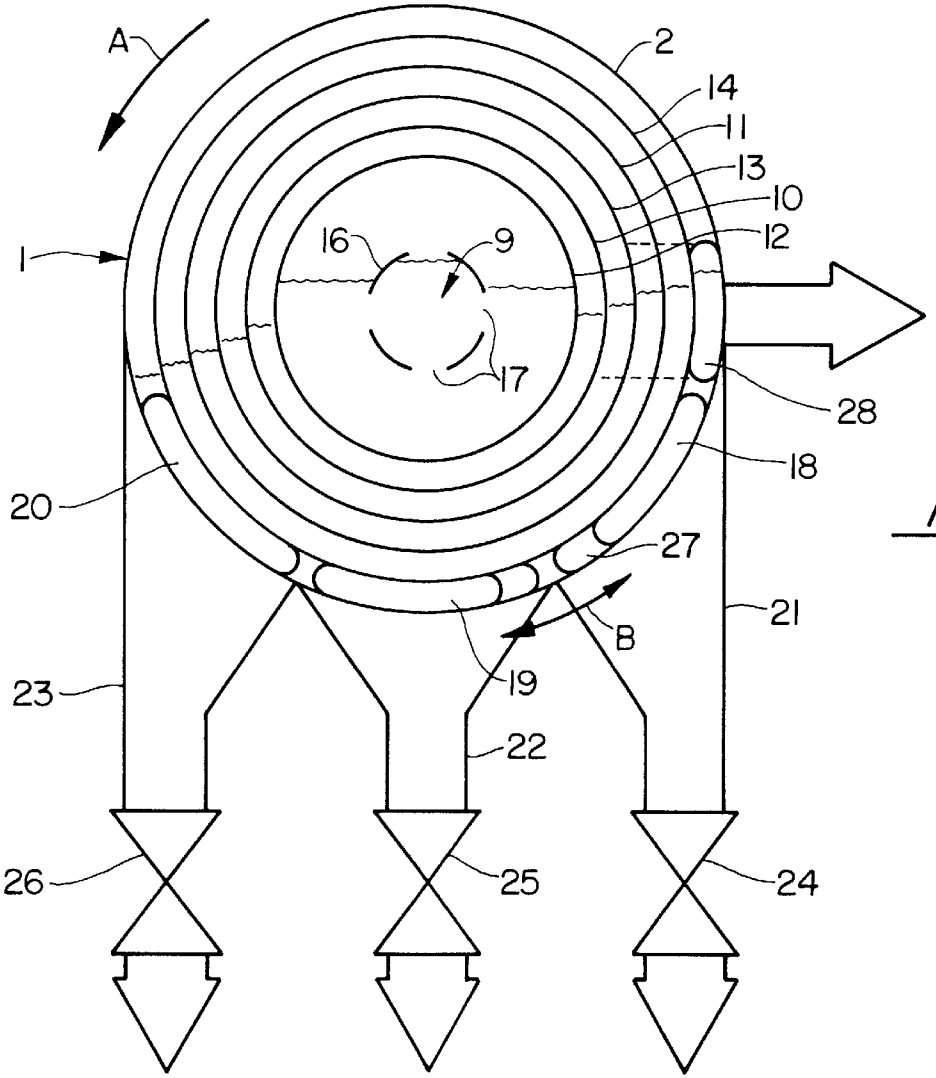

The fractionator shown in FIGS. 1 and 2 consists of a cylindrical drum 1 having a mantle 2 and spaced, parallel end walls 3 and 4. The drum is carried in its end walls by horizontal shafts 5 and 6, respectively, that are journalled in bearings 7 and 8, respectively. The shaft 6 is driveable by a non-shown drive means, so that the drum is rotatable in the rotational direction indicated by an arrow A in FIG. 2. Preferably, the drum is driveable with a variable rotational speed. The shaft 5 is hollow and through same extends an inlet conduit 9 for the suspension to be fractioned, the conduit 9 opening in the end wall 3. Within the drum, coaxial to the rotational axis of the drum 1 is arranged a plurality of cylindrical walls, in the example shown five walls 10–14. Every second such wall is in its one end tightly connected to the end wall 3, and every second to the end wall 4. The walls 10 and 11 are tightly connected to the end wall 3, while there is an axial space between the opposite end wall 4 and the cylindrical walls 10 and 11. Correspondingly, the walls 12, 13 and 14 are tightly connected to the end wall 4 and there is a space between the opposite end wall 3 and the cylindrical walls.

The end wall 4 ends at its connection to the cylinder wall 14, so that the channel formed by the cylinder wall 14 and the drum mantle 2 is open in an axial direction radially outside the end wall 4, there forming an annular outlet 15.

Adjacent cylinder walls 12 and 10, 10 and 13, 13 and 11, 11 and 14, and cylinder wall 14 and drum mantle 2 form, together with the spaces just mentioned, a flow channel leading to and fro between the end walls 3 and 4 of the drum, the channel starting at the centre of the drum and terminating at the outlet 15.

For stiffening of the drum, a radially inner cylindrical wall 16 extends as an extension of the inlet conduit 9 between the end walls 3 and 4 and is connected thereto. Further, the wall 16 is provided with a plurality of perforations 17.

In the example shown, three stationary fraction outlets 18, 19 and 20 are arranged axially outside the outlet 15.

In operation of the fractionator according to the present invention, the drum 1 is rotated in the direction of arrow A, and suspension is introduced through conduit 9 and enters the cylindrical space formed by the inner cylindrical wall 16. Due to gravity the suspension flows down through the perforations 17 in the portion of the cylinder wall 12 facing downwards, along the cylinder wall 12 (to the left in FIG. 1), down through the space-between the cylinder wall 12 and the end wall 3, along the cylinder wall 10 (to the right in FIG. 1), down through the space between the cylinder wall 10 and the end wall 4 and so on, and finally along the inside of the drum mantle 2 to the outlet 15. As appears, flow through the fractionator according to the present invention would occur independently of rotation of the drum, yet along a purely axial path of flow of alternating directions, in the example shown being less than six times the axial length of the drum. Now, due to rotation of the drum, an increase of the fractioning distance occurs. This increase, of course, is dependent on the rotational speed of the drum, since at a higher rotational speed two of the cylinder walls of the drum, between and along which flow takes place, have time to rotate a longer distance during the time a certain volume of suspension is present therebetween, i.e., before it falls down to the level of an underlying channel. If, for instance, the rotational speed of the drum at a certain axial flow is such that a certain volume of particles has time to flow from one end wall to the other during one revolution, the flow distance equals the diagonal of the rectangle, one side of which is the height of one cylinder wall and the other side of which is the circumference of this cylinder wall, i.e., longer than at one revolution of the known fractionator having a helical channel and longer than at stationary fractionator drum according to the present invention. Thus, the path of flow describes a screw line, the pitch of which decreases with increasing rotational speed, i.e., that the liquid volume has time to describe several revolutions relative to the cylinder wall during the passage from one end wall the opposite one. Thus, the fractioning distance is most considerably increased and, consequently, the degree of separation between particles of different sizes.

Upon rotation of the drum, the surface of the suspension will be positioned approximately as shown in FIG. 2, i.e., with increasing raising and lowering, respectively, towards the drum circumference due to the relative speed between the liquid and the rotating walls increasing towards the drum circumference. The fraction outlets 18, 19 and 20 are all, in the example shown, located at the outer channel defined by the cylinder wall 14 and the drum mantle 2, viz., such that the outlet 18 is positioned first and the outlet 20 last, counted in the rotational direction of the drum, and the outlet 19 between the former. Counted in the relative direction of movement of the plug, the order is the opposite. Thus, the largets particles are located in the area of the outlet 20, the medium-sized in the area of the outlet 19 and the finest particles in the area of the outlet 18.

Suitably, the outlets are arcuate having arc lengths corresponding to portions of the total arc length of the suspension plug acquired by experience, so that fractions having desired particle sizes can be drawn off at the different outlets. The outlets are connected to outlet conduits 21, 22 and 23, respectively, which may lead to non-shown containers or devices for further treatment and possible re-introduction in the papermaking process. In order to restrict the flow through the fraction outlets, valves 24, 25 and 26 are suitably arranged in the conduits 21, 22 and 23, respectively. This is particularly important as concerns the lowermost outlet 19, so that an excessive portion of the total suspension plug shall not flow out at that location.

The outlets are shown in FIG. 2 to be somewhat separated in the circumferential direction. For controlling the distribution of fractions between two outlets, there may be arranged between them a shield or wall 27, displaceable in the directions of double arrow B as indicated between the outlets 18 and 19.

As an alternative to arranging the outlet 15 in the end wall 4, an annular outlet can be arranged in the drum mantle close to the end wall 4 (not shown).

The radial distances between the cylindrical walls are shown in FIGS. 1 and 2 to be substantially equal. It may be suitable, however, to gradually decrease the distances towards the drum circumference, since then the relative flow velocity can be kept substantially constant between the different channel turns.

Figure 3:
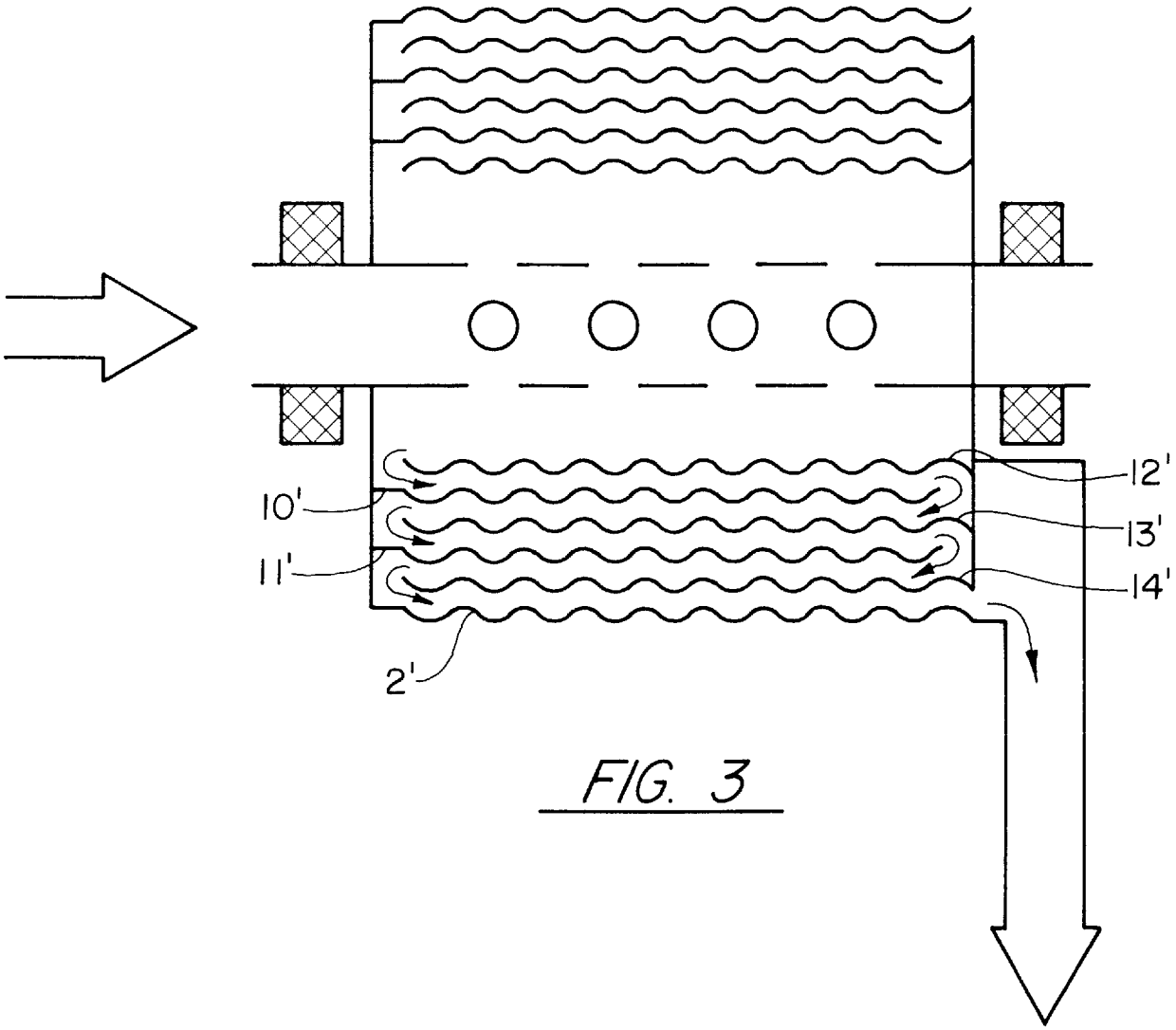
FIG. 3 shows a variant of the shapes of the drum mantle and the internal cylindrical walls.

In order to further extend the flow distance and thereby to increase the areas along which the suspension is flowing, the drum mantle 2' as well as the cylindrical walls 10'–14' conveniently and as shown in FIG. 3 can be undulated.

Figure 4:
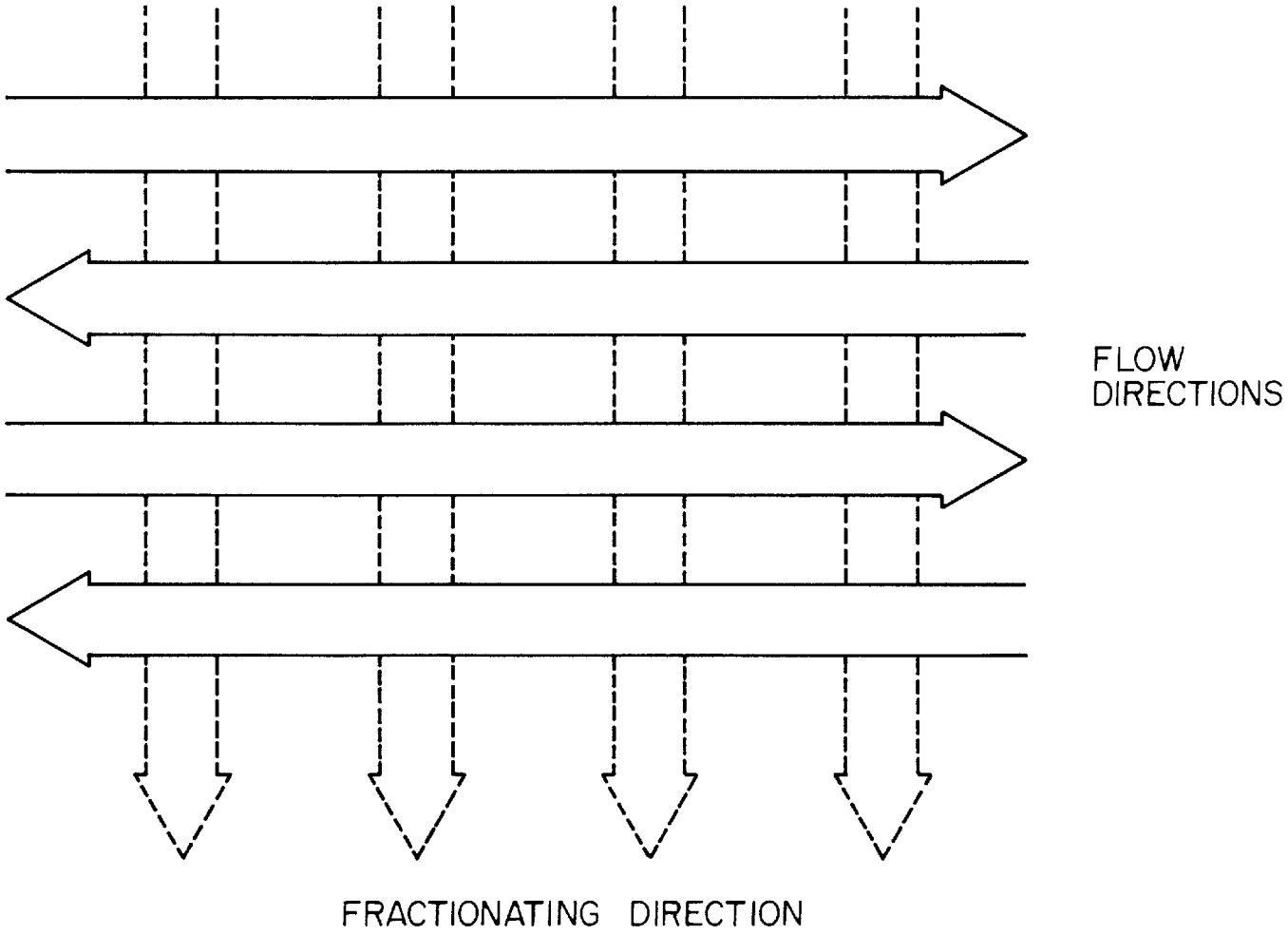
FIG. 4 shows the operational principle of the fractionator according to the present invention.

In FIG. 4 the operational principle for the fractionator according to the present invention is shown. In contrast to the known fractionator, in which the flow direction and the fractioning direction was one and the same, the flow here takes place alternating in the axial directions of the drum, while the fractioning direction is perpendicular to the flow directions.

With the fractionator according to the present invention it is possible to place outlets also at other locations than at the outer flow channel, e.g., between the cylinder walls 11 and 14. Also, it is possible to arrange one outlet common to several channels, as indicated in FIG. 2. Here one outlet 28 is arranged jointly for the four outer channels at the back end of the concentric suspension plugs. Such an outlet, here shown as an overflow outlet, can be utilized to remove very fine particles, for instance for skimming printing ink. Also, an overflow outlet for skimming can be arranged solely at the outer channel.

We claim:

1. Fractionator for fractioning a suspension in at least two fractions, including a drum rotatable about a substantially horizontal axis and having axially spaced end walls, a centrally arranged inlet for suspension, a flow channel for suspension in the drum and outlet means for fractions, characterized in that the flow channel extends from the inlet forth and back between the end walls of the drum and radially outwards towards outlet means (15) for the at least two fractions.

2. Fractionator according to claim 1, characterized in that the flow channel is defined by substantially concentric cylindrical walls, of which every second in its one axial end is tightly connected to one end wall of the drum and every second in its one axial end is tightly connected to the other end wall of the drum, so that flow can take place between the respective other ends of the cylindrical walls and the one and the other end wall, respectively, of the drum.

3. Fractionator according to claim 2, characterized in that the cylindrical walls define straight circular cylinders.

4. Fractionator according to claim 2, characterized in that the cylindrical walls are corrugated in the axial direction of the drum.

5. Fractionator according to claim 2, characterized by a perforated inlet cylinder coaxial to the drum axis and connected to both end walls, the inlet opening out in the inlet cylinder.

6. Fractionator according to claim 2, characterized in that the outlet is annular and arranged in an end wall close to the circumference of the drum.

7. Fractionator according to claim 2, characterized in that the outlet is annular and arranged in the drum close to an end wall.

8. Fractionator according to claim 6, characterized in that after the outlet are arranged fraction outlets for each one of the fractions.

9. Fractionator according to claim 8, characterized by means for regulating the flow through the fraction outlets.

10. Fractionator according to claim 8, characterized in that the fraction outlets are arranged after each other in the circumferential direction of the drum.

11. Fractionator according to claim 10, characterized in that the fraction outlets are arcuate being extended in the circumferential direction of the drum.

12. Fractionator according to claim 6, characterized by an outlet common to a plurality of adjacent flow channels.

13. Fractionator according to claim 1, characterized in that the drum is driveable at variable revolutionary speeds.

* * * * *